US007942051B2

(12) United States Patent
Bryn et al.

(10) Patent No.: US 7,942,051 B2
(45) Date of Patent: May 17, 2011

(54) METHOD AND DEVICE FOR SURVEY OF SEA FLOOR

(75) Inventors: Jan Bryn, Loddefjord (NO); Frode Korneliussen, Bergen (NO); Kjell Erik Dahl, Loddefjord (NO)

(73) Assignee: Argus Remote System AS, Lakesvåg (NO)

( * ) Notice: Subject to any disclaimer, the term of this patent is extended or adjusted under 35 U.S.C. 154(b) by 22 days.

(21) Appl. No.: 12/449,820

(22) PCT Filed: Feb. 26, 2008

(86) PCT No.: PCT/NO2008/000070

§ 371 (c)(1),
(2), (4) Date: Aug. 26, 2009

(87) PCT Pub. No.: WO2008/105667

PCT Pub. Date: Sep. 4, 2008

(65) Prior Publication Data

US 2010/0260553 A1 Oct. 14, 2010

(30) Foreign Application Priority Data

Feb. 26, 2007 (NO) ..... 20071066

(51) Int. Cl.
*G01C 5/00* (2006.01)

(52) U.S. Cl. ..... 73/170.29

(58) Field of Classification Search ..... None
See application file for complete search history.

(56) References Cited

U.S. PATENT DOCUMENTS

| | | | | |
|---|---|---|---|---|
| 3,628,205 | A * | 12/1971 | Starkey et al. | 441/25 |
| 4,121,806 | A * | 10/1978 | Iato et al. | 166/355 |
| 5,113,377 | A * | 5/1992 | Johnson | 367/20 |
| 2003/0218937 | A1 * | 11/2003 | Berg et al. | 367/16 |
| 2005/0160959 | A1 | 7/2005 | Roodenburg et al. | |
| 2007/0125289 | A1 | 6/2007 | Asfar et al. | |
| 2008/0298173 | A1 * | 12/2008 | Guigne | 367/16 |
| 2010/0172206 | A1 * | 7/2010 | Guigne | 367/16 |

FOREIGN PATENT DOCUMENTS

| | | | |
|---|---|---|---|
| EP | 0 290 325 | A1 | 4/1988 |
| EP | 1 394 822 | A2 | 3/2004 |
| WO | WO 8503269 | A1 | 8/1985 |

OTHER PUBLICATIONS

Int'l. Search Report, Jun. 4, 2008.

* cited by examiner

*Primary Examiner* — Andre J Allen
(74) *Attorney, Agent, or Firm* — Abelman, Frayne & Schwab

(57) ABSTRACT

A method and a device are described for survey of an ocean floor, and also cables and the like on the ocean floor in ocean areas with strong currents, as a submersible survey platform (10) is lowered from a surface vessel with the help of a winch system (12) on the vessel to a desired distance in relation to the ocean floor. The desired fixed distance from the ocean floor is controlled in real time in relation to the topography of the ocean floor at the same time as the vessel moves forward to drive the platform (10) along a desired trajectory with the help of one or more sensors that register the distance to and possibly direction towards the ocean floor and which are connected to the winch (12) via a control system (14). At the same time, sideways movements of the platform (10) caused by currents are compensated for with the help of one or more sensors that are connected to a number of thrusters (16) on the platform (10) via said control system (12).

18 Claims, 3 Drawing Sheets

METHOD AND DEVICE FOR SURVEY OF SEA FLOOR

Figure 1:
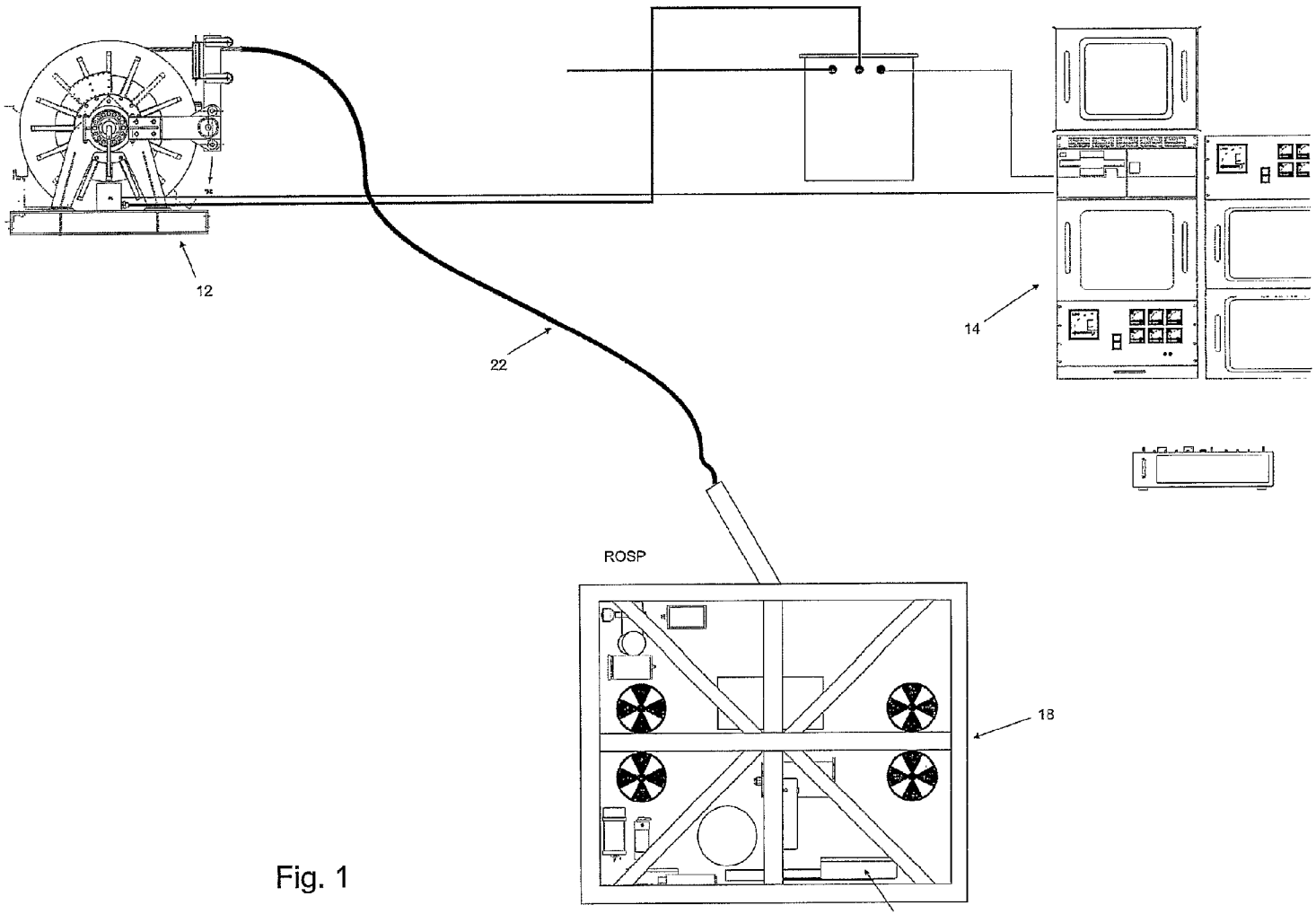

The present invention relates to a method and a device for survey of the ocean floor, and also cables and the like on the ocean floor, in ocean areas with strong currents, in that a submersible survey platform is lowered from a surface vessel with the help of a winch system on the vessel to a desired depth in relation to the ocean floor.

According to the invention, a submersible and remotely controllable survey platform, a so-called ROSP (Remote Operated Survey Platform) is provided, which can replace today's ROVs that are used for surveys of ocean floors, pipes and cables.

ROSP is a platform to which the survey sensors are secured and from where data from these are collected. The difference between a traditional survey ROV and an ROSP is that a traditional ROV has motors with propellers operating in all planes and an ROSP has basically only propellers that operate in the horizontal plane and to move in the vertical plane there is a winch which initially brings it up and down in relation to the desired depth. An ROSP is constructed such that it is preferably "very" negative, in contrast to an ROV which is approximately neutral. The advantage with an ROSP is that it can be weighed down according to the conditions under which it will operate, i.e. current and speed above the bottom.

An ROSP collects all survey data down at the instrument platform. On this platform there are instruments that keep it at a fixed distance from the bottom. The instruments control the winch so that it lets out or winches in as and when required. This ensures that the ROSP has a stable, desired distance to the bottom or the object. In the horizontal plane, HPR, Doppler and north seeking gyros can be used to regulate the motor that keeps the ROSP in position during the survey. This means that a survey can be carried out faster and be carried out in areas with strong currents in a better way than has been done before.

Consequently, the background and object of the present invention is to be able to carry out surveys in ocean areas with strong currents and at the same time be able to carry out a quality survey with the best instruments available.

By combining the sensors with the control system of the ROSP one will get a survey platform which is very stable in all conditions and environments. An ROSP does not have the same limitations as an ROV, i.e. it can carry more survey sensors than a survey ROV.

From prior art attention shall be drawn to, among others, document US A1 2005/01609959. This describes an ROV which is submerged from a surface vessel with the help of cables. A template can, for example, be fastened to the ROV and the ROV can be used for anchoring and positioning of said template to the ocean floor. The ROV carries equipment for positioning in relation to the ocean floor and propellers for propulsion in the horizontal plane. It is not mentioned in said document that the ROV is used for moving along the ocean floor for the purpose of carrying out a survey of the ocean floor or of equipment on the ocean floor. It is stated in US A1 2005/1609959 that the aim is to provide a method for accurate and safe positioning of an object on a fixed installation location on the ocean floor, and also a method for lowering the objects with the use of the ROV.

Furthermore, attention is also given to JP 9090052 and WO 85/03269 as examples of prior art.

The above mentioned objects are obtained with a method described in the independent claim 1, while alternative embodiments are given in the dependent claims 2-4.

According to the method defined in the characteristic in the independent claim 1, a real time regulation at a fixed distance to the ocean floor in relation to the topography of the ocean floor is achieved, at the same time as the vessel moves forward to drive the platform in a desired trajectory with the help of one or more sensors that register the distance to and possibly direction towards the ocean floor and which is connected to the winch via a control system, and at the same time compensate for sideways displacements of the platform that are caused by currents, with the help of one or more sensors that are connected to a number of thrusters on the platform, via said control system.

In alternative embodiments, the platform can be weighed down depending on what depth the platform shall operate at and the local currents, such that it obtains a desired negative buoyancy. Furthermore, at greater depths, a pressure influencer can be used to force the platform down when the vessel moves forward. Said thrusters can preferably also be regulated to turn the platform around in relation to the desired position in the water, in addition to sideways movement of the platform.

The invention also relates to a device for use in the method, as described in the independent claim 5, while alternative embodiments of the device are given in the dependent claims 6-8.

According to the device defined in the characteristic in the independent claim 5 the platform comprises, preferably a number of sensors that are chosen from a group encompassing, depth sensors, altimeters, differential measuring devices, pressure gauges and HPR, so that it can control a desired fixed distance to the ocean floor in real time and so that at the same time it can compensate for sideways movements of the platform due to currents, the platform comprises a number of sensors that are chosen from a group encompassing, north seeking gyros, HPR, Doppler and INS.

To carry out a survey, the platform can comprise a number of survey sensors that are chosen from a group comprising; multi-ray weights, side-scan sonars, sonars, sub bottom profiles, video cameras, laser cameras, still photos, cameras, etc. A control system is preferably connected to said sensors, and the control system can be set up to individually control the winch and said thrusters to regulate the position of the platform in the water, and also to receive data collected by the survey sensors. In an alternative embodiment the platform can be shaped as an edged, frame construction through which water can flow, with at least one thruster in more than one corner.

The invention shall now be described in more detail with the help of the enclosed figures, in which FIG. 1 shows a principle diagram of the system according to the invention.

Figure 2:
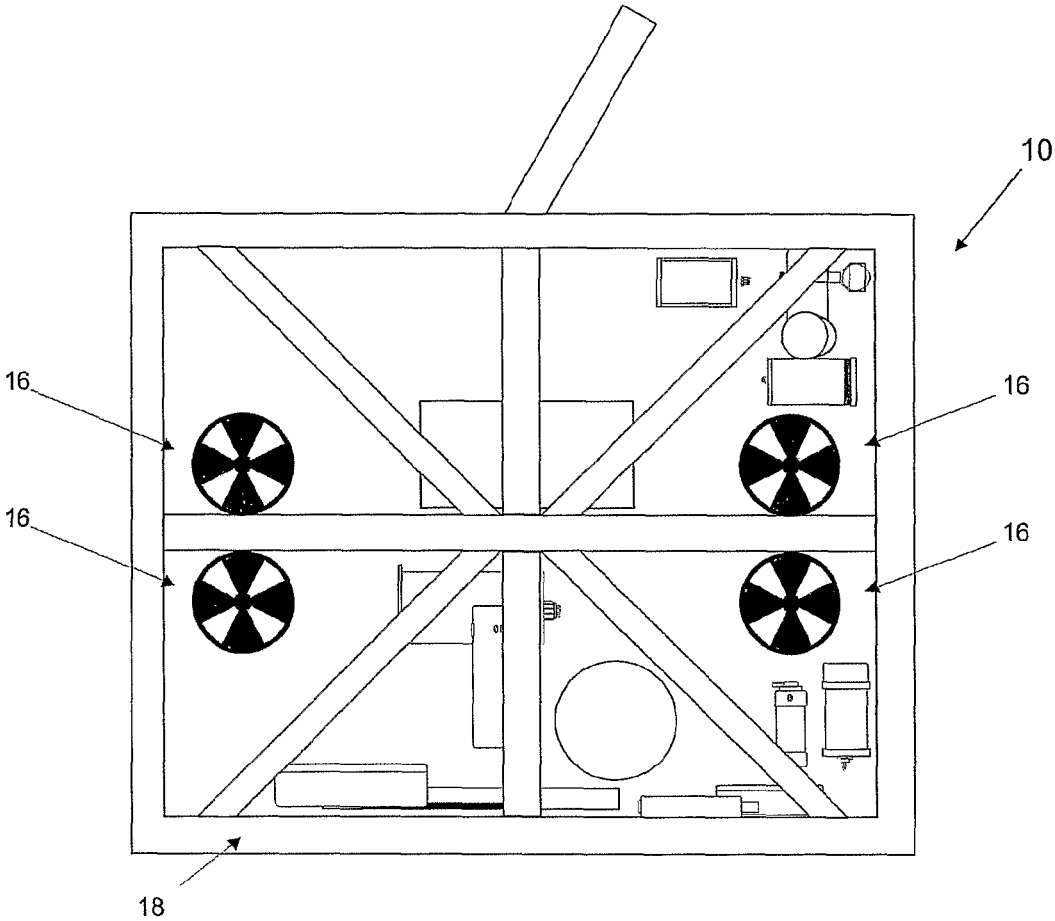
Figure 3:
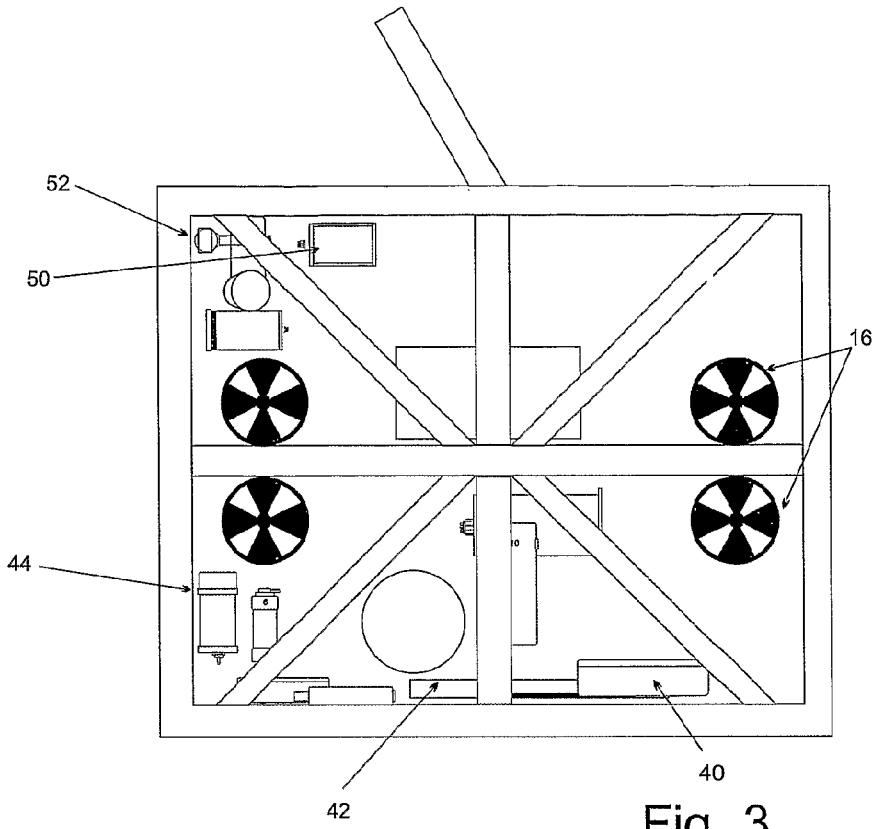
Figure 4:
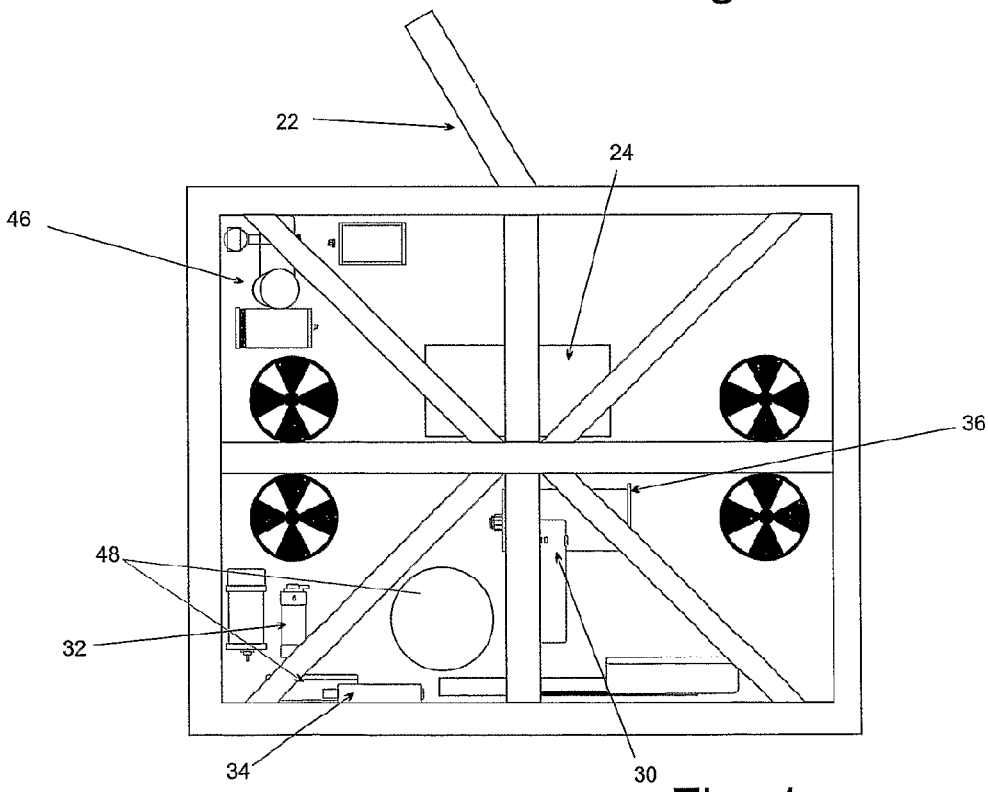

FIGS. 2-4 show an ROSP according to the invention viewed from different angles.

The ROSP according to the invention, or sensor-platform 10 as it is also called, can have two or more versions depending on the depth and environmental conditions. The standard platform can be weighed down to make it negative. This to stay at the chosen depth without being affected by currents. In an embodiment intended for greater depths, a depressor can be placed on the cable to be able to force the platform down when the vessel moves forward.

The system comprises a vessel (not shown). The vessel drives the ROSP forwards so that the course of the ROSP is the course of the vessel. The ROSP is connected to a winch 12 and this controls the depth of the ROSP. The winch 12 is preferably arranged on board the vessel, but it can also be imagined that the platform can be equipped with winchregulating appliances. The distance to the bottom is also preferably controlled by the winch 12. To keep the ROSP submerged and along the trajectory which is chosen by the vessel, the ROSP uses its vectorised motor system. This motor system and control system will hold the ROSP in a horizontal position in relation to the vessel.

For control of the position of the ROSP in both the horizontal and vertical planes, a so-called HPR system can be used. HPR is an abbreviation for Hydro Acoustic Position Reference, an inertial navigation system. The control system 14 uses the data string for the different sensors in a regulation loop, which the winch 12 and thrusters 16 carry out. The winch 12 controls the adjustment in the vertical plane and the thrusters 16 control adjustment in the horizontal plane.

The sensors that are used to position the ROSP in the vertical plane are preferably chosen from a group of depth sensors 30, altimeter 32 (distance from the bottom), differential depth gauges 34, pressure, etc., and HPR. In the horizontal plane, north seeking gyro, HPR, Doppler and INA system 36 can be used.

Hain, Doppler, std can provide inputs to both the vertical and the horizontal regulation because one here talks about movements in all planes. North seeking gyros are used to determine the absolute heading.

An ROSP is equipped, at all times, with the sensors that the task requires. With its flexibility, it can carry more sensors than today's ROVs can. The software which the sensors have as standard are connected together with the ROSP control system 14 and this gives the ROSP the ability to carrying out a survey very well.

The control system 14 of the ROSP, coupled with the sensor data, provide the ROSP with a very high resolution of the vertical and the horizontal position.

To carry out a survey, survey sensors such as multi-ray weights 40, side-scan sonars 42, sonars 44, sub-bottom profiles 48, video cameras, laser cameras, still photos, cameras 46, etc., can be used. Furthermore, the platform can be equipped with lights such as halogen lights 52 and HID lights 50.

In one embodiment of the method according to the invention, the vessel finds its position and the ROSP is lowered to the desired depth, whereupon the winch 12 will take over the regulation of the vertical position. When the vessel moves along a line, any current will try to pull the ROSP out of the line. The motor control system of the ROSP will then hold the ROSP in the horizontal position such that the line is maintained. When the speed of the vessel increases and the forces that act on the cable lift the ROSP, the winch will counteract to hold the vertical position or the ROSP will be weighed down based on previously gained experience.

When the ROSP is used at ocean depths, a depressor (pressure influencer) is used. The depressor will force itself down so that it counteracts the forces that will lift the cable at increased speeds of the vessel.

The system is an integrated control and survey system ICSS. ICSS so that it can carry out surveys faster and with better quality than is possible with today's technology.

As FIG. 2, among others, shows, the platform 10 can be shaped as a frame structure 18 through which water can flow. In the embodiment shown, the frame structure 18 has six side surfaces with thrusters 16 placed in four of the corners. The frame structure can, of course, have any suitable shape and is not limited to that shown here. The location of the different sensors and equipment is set according to the survey that is to be carried out.

The invention claimed is:

1. Method for surveying the ocean floor, and cables and other structures on the ocean floor in areas with strong currents using, a submersible survey platform (10) lowered from a surface vessel by a winch system (12) on the vessel to a desired depth in relation to the ocean floor, and controlling the distance from the ocean floor in relation to the topography of the ocean floor while the vessel moves the platform (10) along a desired trajectory using the winch (12) to control the depth of the platform, characterized by controlling in real time the distance to the ocean floor using one or more sensors that register distance to and, optionally, the direction towards the ocean floor the one or more sensors being connected to the winch (12) via a control system (14), and at the same time compensating for any sideways movements of the platform (10) caused by currents using one or more sensors that are connected to a plurality of thrusters (16) mounted on the platform (10) via said control system (14).

2. Method according to claim 1, characterized in that the platform (10) is being weighed down, depending on the depth it is to operate at and the local current, so that a negative buoyancy is established.

3. Method according to claim 1, characterized in that a pressure influence is used at greater depths to force the platform down when the vessel moves forward.

4. Method according to claim 1 characterized in that said thrusters (16) in addition to sideways movements of the platform are also controlled to turn the platform (10) around in relation to a desired position in the water.

5. Remotely controllable survey platform for surveying the ocean floor, and cables and other structures on the ocean floor in ocean areas with strong currents, in that a submersible survey platform (10) is lowerable from a surface vessel with the help of a winch system (12) on the vessel to a predetermined depth in relation to the ocean floor, and to control with the winch (12) desired fixed distance to the ocean floor in relation to the topography of the ocean floor, at the same time as the vessel moves forward to move the platform (10) along a desired trajectory, characterized in that a control system (14) to control said predetermined fixed distance from the ocean floor in real time, with the help of one or more sensors that register distance to and optionally the direction towards the ocean floor of the control system being connected to the winch (12), and that said control system (14) at the same time compensates for sideways movements of the platform (10) caused by currents using, one or more sensors that are connected to a plurality of thrusters (16) mounted on the platform (10).

6. Remotely controllable survey platform according to claim 5, characterized in that the platform (10) comprises a number of sensors, in order to in real time to control said desired fixed distance to the ocean floor, that are chosen from a group comprising, depth sensors, altimeters, differential depth measuring devices, pressure gauges and HPR.

7. Remotely controllable survey platform according to claim 5, characterized in that the platform (10), for at the same time to compensate for sideways movements of the platform (10) caused by currents, comprises a number of sensors that are chosen from a group comprising; north seeking gyros, HPR, Doppler and INS.

8. Remotely controllable survey platform according to claim 5, characterized in that the platform (10) for carrying out a survey comprises a number of survey sensors selected from the group consisting of multi-ray weights, side-scanning sonar, sonars, sub-bottom profiles, video cameras, laser cameras, still photos, and cameras.

9. Remotely controllable survey platform according to claim 5, characterized in that the control system (14) is connected to said sensors, and that the control system is arranged to control the winch (12) and said thrusters (16) to control the position in the water of the platform, and also to receive data collected by the survey sensors.

10. Remotely controllable survey platform according to claim 5, characterized in that the platform (10) is shaped in an edged frame structure (18) through which water can flow, with at least one thruster (16) in more than one corner.

11. Method according to claim 2 characterized, in that a pressure influencer is used at greater depths to force the platform down when the vessel moves forward.

12. Method according to claim 2, characterized in that said thrusters (16) in addition to sideways movements of the platform are also controlled to turn the platform (10) around in relation to a desired position in the water.

13. Method according to claim 3, characterized in that said thrusters (16) in addition to sideways movements of the platform are also controlled to turn the platform (10) around in relation to a desired position in the water.

14. Remotely controllable survey platform according to claim 6, characterized in that the platform (10) for carrying out a survey comprises a number of survey sensors selected from the group consisting of multi-ray weights, side-scanning sonar, sonars, sub-bottom profiles, video cameras, laser cameras, still photos, and cameras.

15. Remotely controllable survey platform according to claim 7 characterized in that the platform (10) for carrying out a survey comprises a number of survey sensors selected from the group consisting of multi-ray weights, side-scanning sonar, sonars, sub-bottom profiles, video cameras, laser cameras, still photos, and cameras.

16. Remotely controllable survey platform according to claim 6, characterized in that the control system (14) is connected to said sensors, and that the control system is arranged to control the winch (12) and said thrusters (16) to control the position in the water of the platform, and also to receive data collected by the survey sensors.

17. Remotely controllable survey platform according to claim 7, characterized in that the control system (14) is connected to said sensors, and that the control system is arranged to control the winch (12) and said thrusters (16) to control the position in the water of the platform, and also to receive data collected by the survey sensors.

18. Remotely controllable survey platform according to claim 8, characterized in that the control system (14) is connected to said sensors, and that the control system is arranged to control the winch (12) and said thrusters (16) to control the position in the water of the platform, and also to receive data collected by the survey sensors.

* * * * *